US006774092B2

(12) United States Patent
Fu et al.

(10) Patent No.: US 6,774,092 B2
(45) Date of Patent: Aug. 10, 2004

(54) ADDITIVE COMPOSITION FOR GEARBOX OIL

(75) Inventors: Xisheng Fu, Gansu (CN); Xiuling Hua, Gansu (CN)

(73) Assignee: PetroChina Company, Ltd., Beijing (CN)

( * ) Notice: Subject to any disclaimer, the term of this patent is extended or adjusted under 35 U.S.C. 154(b) by 0 days.

(21) Appl. No.: 10/222,606

(22) Filed: Aug. 16, 2002

(65) Prior Publication Data

US 2003/0045436 A1 Mar. 6, 2003

(30) Foreign Application Priority Data

Aug. 24, 2001 (CN) ..... 01130779 A

(51) Int. Cl.[7] ..... C10M 141/12

(52) U.S. Cl. ..... 508/192; 508/194; 508/198; 508/280; 508/287; 508/371; 508/375; 508/377; 508/379; 508/390; 508/551; 508/569

(58) Field of Search ..... 508/569, 378, 508/192

(56) References Cited

U.S. PATENT DOCUMENTS 5,415,794 A * 5/1995 Aberkane et al. ..... 508/569
5,763,372 A * 6/1998 Tersigni et al. ..... 508/569
5,843,874 A * 12/1998 Macpherson et al. ..... 508/470
5,942,470 A * 8/1999 Norman et al. ..... 508/189
6,287,522 B1 9/2001 Lomas
6,303,547 B1 * 10/2001 Balasubramaniam ..... 508/454
6,432,889 B1 * 8/2002 Kinoshita et al. ..... 508/399
6,444,622 B1 * 9/2002 Balasubramaniam ..... 508/187
6,482,777 B2 * 11/2002 Cain ..... 508/185

OTHER PUBLICATIONS

Smalheer et al, "Lubricant Additives", Chapter I–Chemistry of Additives, pp. 1–11, 1967.*

* cited by examiner

*Primary Examiner*—Ellen M. McAvoy
(74) *Attorney, Agent, or Firm*—McGuire Woods LLP

(57) ABSTRACT

Disclosed is an additive composition that can be mixed with various types of basic oils to produce a lubricant that can meet the international standards of manual truck gearbox oils. A preferred embodiment includes various quantities of an isobutylene sulfide, zinc dialklydithiophosate and other components. Component properties of the additive composition are selected to produce a lubricant that has good thermal stability, rust-resisting and endurance qualities and that has a low cost of use and production.

8 Claims, No Drawings

ADDITIVE COMPOSITION FOR GEARBOX OIL

FIELD OF INVENTION

The invention relates to a sort of additive composition used for manual gearbox oil, especially to the lubrication oil of truck gearbox. It belongs to the technical field of lubricating oil additives.

BACKGROUND OF INVENTION

The compound agent for manual gearbox oil is used to prepare the oil of manual truck gearboxes of every viscosity brand and meets the international standards of API MT-1 for the manual truck gearbox oil. The additional volume of the agent is one of the most important indexes to evaluate the quality, efficiency and technology of the additive. In the prior art, the manual gearbox oil additive published in U.S. Pat. No. 5,763,372 comprises alkyl succinimide, sulphate and phosphorous antiwear agent. However, it is different from the composition of the present invention. Also, the Chinese Patent application Nos. 97112341.1 and 97112340.3 refer to the manual gearbox oil and the compound agent thereof, but in comparison with the present invention, the additional volume of the said compound agent is much higher, and that compound agent of the manual gearbox oil cannot meet the requirement of the specification standards of API MT-1.

An object of the present invention, therefore, is to provide a sort of additive composition that can be used in various types of basic oil. Manual truck gearbox oil of 90, 140, 85W/90, 85W/140, 80W/90, 80W/140 and 75W/90 mixed with the composition of the present invention can meet the specification standards of API MT-1.

SUMMARY OF INVENTION

In order to realize all the above-mentioned objects, each component in the additive composition is deliberately chosen. Not only are the properties and advantage of every component taken into consideration, but priority is also given to the thermal stability, rust-resisting quality and endurance of the component. The performance of every component in the additive cannot realize the above-mentioned objectives alone. It is necessary to research the performance of every component so as to make the additive superior to the prior art.

In the present invention, the amount of sulfur in the product is 26–30%, that of phosphorous is 1.5–2% and nitrogen 0.2–0.6% based on the total quality of the additive composition. It is of good thermal stability, rust-resisting quality and endurance. The oil of various viscosities such as 90, 140, 85W/90, 85W/140, 80W/90, 80W/140, 75W/90 mixed with 2.4% of the present additive composition meets the specification standards of API MT-1. The present additive composition has low expense of use and production, and the product represents good economic and social benefits. Being easy to use and of excellent performance, it has a bright market expectation.

In a preferred embodiment, an additive composition designed for manual gearbox oil of the present invention based on the total quality of the composition comprises:

An isobutylene sulfide in an amount of 40–90%;

A zinc dialklydithiophosphate and the derivative thereof in an amount of 1–20%;

A component selected from the group consisting of phosphite ester and the derivative thereof, phosphate and the derivative thereof, and the randomly combined mixture thereof in an amount of 10–40%;

A component selected from the group consisting of benzotriazole fatty amine salts and the derivative thereof, sulfurized oxomolybdenum dialkydithiophosphate and the derivative thereof, fatty acid ester and its boride, and the randomly combined mixture thereof in an amount of 0.5–10%;

A component selected from the group consisting of succinimide and its boride, organic sulfonate, fatty acid amide and its boride, and the randomly combined mixture thereof in an amount of 2–15%; and A component selected from the group consisting of ester borate and its derivative, amine antioxidant, phenol antioxidant, and the randomly combined mixture thereof in an amount of 0.5–10%.

In other words, the present additive composition in a preferred embodiment of the present invention comprises the following components: component (A) at least sulfur-containing extreme pressure (Ep) antiwear agents; component (B) at least an antioxidant and anticorrosive agent; component (C) at least phosphorous antiwear agent; component (D) at least a friction modifier; component (E) at least an antirusting agent; and component (F) at least an antioxidant agent. The said component (A) is preferably isobutylene sulfide in amount of 40–90%, more preferably 40–80% based on the total quantity of the composition. The said component (B) is preferably zinc dialklydithiophosphate and its derivative in amount of 1–20%, more preferably 1–15% based on the total quantity of the composition. The said component (C) is preferably phosphite ester and its derivative, phosphate and its derivative, or the mixture thereof in amount of 10–40%, more preferably 10–30% based on the total quanity of the composition. Moreover, the acidic phosphite ester or neutral phosphite ester or the mixture thereof is preferably for the component (C). The component (D) is preferably benzotriazole fatty amine salts and its derivative, sulfurized oxomolybdenum dialkydithiophosphate and its derivative, alicyclic ester and its boride, or the randomly-combined mixture thereof in amount of 0.5–10%, more preferably 1–8%, based on the total quantity of the composition. The said component (E) is preferably succinimide and its boride, organic sulfonate, fatty acid amide and its boride, or the randomly combined mixture thereof in amount of 2–15%, more preferably 2–10% based on the total quality of the composition. The said component (F) is preferably borate ester and its derivative, amine antioxidant, phenol antioxidant, or the randomly combined mixture thereof in amount of 0.5–10%, more preferably 1–8% based on the total quantity of the composition.

Therefore, it is very clear for the composition of the present invention to contain (A) a sort of sulphide Ep antiwear agent; (B) a sort of antioxidant and antiseptic agent; (C) a sort of phosphorous antiwear agent; (D) a sort of friction modifier; (E) a sort of antirust agent; and (F) a sort of antioxidant agent.

According to a preferred embodiment of the present invention, a method for preparation of the additive composition comprises the steps of proportionally mixing the said component (A) as the Ep antiwear, the said component (C) as antiwear and the said component (D) as friction modifier in an enamel kettle with a mixer; then proportionally putting the said component (B) as antioxidant and antirusting, the said component (E) as antirusting, and the said component (F) as antioxidant into the kettle in order to get a mixture in the temperature of 60–70° C. along with mixing for 4 hours until the mixture is dissolved completely and becomes evenly transparent.

For choosing the components of the additive composition, two laboratories are used to simulate and evaluate the efficiency of the product with several experimental methods, including Lubricating Oil Ep Test (GB/T 3142) and Lubricating Oil Antiwear Test (SH/T0189).

For evaluating whether the additive composition conforms to the API MT-1 specification standards after adding it into the basic oil, the Copper Stain Test for petroleum products (GB/T5096 or ASTM D130), Lubricating Oil Carrying Capacity Test (CL-100) (SH/T0306 or ASTM D5182), Gear Oil Thermal-Oxidative Stability Test (L-60, L-60-1), Gear Oil High-Temperature Stability Test (ASTM D5579), Adaptability to Sealing Material Test (ASTM D5662), and Lubricating Oil Foam Resistance Test (ASTM D 892) are carried out separately.

DETAILED DESCRIPTION OF THE EMBODIMENTS

The efficiency of the invention is further explained through the following examples.

EXAMPLE 1

In the example 1, the two kinds of the additive compositions, e.g. additive I and additive II, were used for the test. Additive composition I contained 70% isobutylene sulfide, 5% zinc dialklydithiophosphate, 15% acidic phosphite, 3% sulfurized oxomolybdenum dialklydithiophosphate, 5% middle based petroleum sulfonate and 2% amine antioxidant.

Additive composition II contained the same components as additive composition I except zinc dialklydithiophosate.

Additive composition I and additive composition II were respectively mixed into the basic oil of 85W/90 (see Table 1 for the properties of this oil) with the same proportion of 2.4%. The results obtained are listed in Table 2.

TABLE 1

Quality of Basic Oil 85W/90

| Item | Quality |
|---|---|
| Kinematic viscosity at 100° C. | 18.73 ($mm^2/s$) |
| Apparent viscosity at −12° C. | 219800 ($mp_a \cdot s$) |
| Pour-point | −17 (° C.) |
| Flash point (open) | 212 (° C.) |

TABLE 2

Evaluation Results of Additive Compositions I and II

| Item | Additive I | Additive II |
|---|---|---|
| Copper stain level (121° C. × 3 h) | 1a | 3b |

The results showed that zinc dialklydithiophosphate and its derivative obviously improved the rust-resisting quality of the gearbox oil.

EXAMPLE 2

Additive composition III was selected for the further experiment. It contained the same components of additive I except acidic phosphite. Additive compositions I and III were respectively mixed into the basic oil of 75W/90 (see Table 3 for the properties of this oil) with the same proportion of 2.4%. The results obtained are listed in Table 4.

TABLE 3

Quality of Basic oil 75W/90

| Item | Quality |
|---|---|
| Kinematic viscosity at 100° C. | 14.87 ($mm^2/s$) |
| Apparent viscosity at −40° C. | 139800 ($mp_a \cdot s$) |
| Pour-point | −47 (° C.) |
| Flash point (open) | 189 (° C.) |

TABLE 4

Evaluation Results of Additive Compositions I and III

| Item | Additive I | Additive III |
|---|---|---|
| Four ball Ep test PB, N | 1078 | 882 |
| Four ball wear test d, mm (392N, 60 min) | 0.39 | 0.52 |

Results of the test showed that phosphite ester (component C) could obviously improve the Ep antiwear property of the gearbox oil.

EXAMPLE 3

Additive composition IV was also selected for the experiment. It contained 60% isobutylene sulfide as component A; 8% zinc dialklydithiophosphate as component B; 15% neutral phosphite ester as component C; 5% benzotriazole fatty amine salts as component D; 10% boric succinimide as component E; and 2% phenol antioxidant as component F. The additive composition IV was put into the basic oil of 85W/90 (properties listed in Table 1) with the proportion of 2.4%. The results obtained are listed in Table 5.

The results showed that additive composition IV had good thermal stability, rust-resisting quality and high-temperature endurance. With the amount of 2.4% (quality) of the additive composition, the gearbox oil of 85W/90 met the requirements of API MT-1.

TABLE 5

Evaluation Results of Additive IV

| Item | Index (API MT-1) | | Measured Value |
|---|---|---|---|
| Thermal stability & Cleanness of the Parts (L-60-1) | Carbon deposit and varnish of bull gears and paint film | >7.5 | 8.13 |
| | Oil sludge | >9.4 | 9.67 |
| Adaptability to sealing materials (ASTM D5662) | Passed | | Passed |
| Adaptability to copper parts (ASTM D130) | Rating | <2a | 1a |
| Antiwear property (FZG) | Failure rate | >11 | >11 |
| Oxidation resistance (I-60) | Increase in viscosity | >100 | 31.55 |
| | Pentane insoluble % | <3.0 | 1.60 |
| | Toluene insoluble % | >2.0 | 0.90 |
| High-temp lubrication stability (ASTM D5579) | Cycle index | >66000 | 155800 |
| Foam resistance (ASTM D892) | 24° C.: | <20/0 | 0/0 |
| | 93.5° C.: | <50/0 | 10/0 |
| | Then 24° C.: | <20/0 | 0/0 |
| Bin stability (FTM3440) | Liquid deposit % | <0.50 | 0 |
| | Solid deposit % | <0.25 | 0.004 |

We claim:

1. An additive composition designed for manual gearbox oil based on a total quality of the composition, comprising:

40–90% isobutylene sulfide;

1–20% zinc dialklydithiophosphate and a derivative thereof;

a component selected form the group consisting of phosphate ester and a derivative thereof, phosphate and a derivative thereof, and a randomly combined mixture thereof in an amount of 10–40%;

a component selected from the group consisting of benzotriazole fatty amine salts and a derivative thereof, sulfurized oxomolybdenum dialkydithiophosphate and a derivative thereof, fatty acid ester and its boride, and a randomly combined mixture thereof in an amount of 0.5–10%;

a component selected from the group consisting of succinimide and its boride, organic sulfonate, fatty acid amide and its boride, and a randomly combined mixture thereof in an amount of 0.5–10%.

2. The additive composition according to claim 1, wherein the isobutylene sulfide is in an amount of 40–80% based on the total quality of the composition.

3. The additive composition according to claim 1, wherein the component selected from the group consisting of phosphate ester and a derivative thereof, phosphate and a derivative thereof, and the randomly combined mixture thereof is in an amount of 10–30% based on the total quality of the composition.

4. The additive composition according to claim 1, wherein the phosphate ester is one of acid phosphate, neutral phosphate, or the randomly combined mixture thereof.

5. The additive composition according to claim 4, wherein an amount of the phosphate ester is 10–30% based on the total quality of the composition.

6. The additive composition according to claim 1, wherein the component selected from the group consisting of benzotriazole fatty amine salts and a derivative thereof, sulfurized oxomolybdenum dialkydithiophosphate and a derivative thereof, fatty acid ester and its boride, and a randomly combined mixture thereof is in an amount of 1–8% based on the total quality of the composition.

7. The additive composition according to claim 1, wherein the component selected from the group consisting of succinimide and its boride, organic sulfonate, fatty acid amide and its boride, and a randomly combined mixture thereof is in an amount of 2–10% based on the total quality of the composition.

8. The additive composition according to claim 1, wherein the component selected from the group consisting of ester borate and its derivative, amine antioxidant, phenol antioxidant, and a randomly combined mixture thereof is in an amount of 1–8% based on the total quality of the composition.

* * * * *

UNITED STATES PATENT AND TRADEMARK OFFICE

CERTIFICATE OF CORRECTION

PATENT NO. : 6,774,092 B2
DATED : August 10, 2004
INVENTOR(S) : Xisheng Fu et al.

It is certified that error appears in the above-identified patent and that said Letters Patent is hereby corrected as shown below:

Column 5,
Line 5, please delete "dialklydithophosphate" and insert -- dialkyldithiophosphate --

Signed and Sealed this

Twelfth Day of April, 2005

JON W. DUDAS
*Director of the United States Patent and Trademark Office*